US008561241B2

(12) United States Patent
Lim et al.

(10) Patent No.: US 8,561,241 B2
(45) Date of Patent: Oct. 22, 2013

(54) MOTORIZED ROTATING AND/OR OSCILLATING APPLICATOR

(75) Inventors: Cindy Lim, Santa Monica, CA (US); Adrian C. Apodaca, Santa Monica, CA (US)

(73) Assignee: HCT Asia Ltd, Central (HK)

( * ) Notice: Subject to any disclaimer, the term of this patent is extended or adjusted under 35 U.S.C. 154(b) by 529 days.

(21) Appl. No.: 12/721,176

(22) Filed: Mar. 10, 2010

(65) Prior Publication Data

US 2011/0223315 A1 Sep. 15, 2011

(51) Int. Cl.
*A46B 13/02* (2006.01)

(52) U.S. Cl.
USPC ..... 15/22.2; 15/22.1; 15/22.4

(58) Field of Classification Search
USPC ..... 15/21.1, 22.1, 22.2, 22.423, 28, 97.1
See application file for complete search history.

(56) References Cited

U.S. PATENT DOCUMENTS

| | | | | |
|---|---|---|---|---|
| 3,183,538 | A * | 5/1965 | Hubner | 15/22.1 |
| 3,733,634 | A * | 5/1973 | Golbe | 15/28 |
| 4,027,348 | A * | 6/1977 | Flowers et al. | 15/22.1 |
| 4,312,333 | A * | 1/1982 | Dreybus | 601/95 |
| 4,603,448 | A * | 8/1986 | Middleton et al. | 15/22.1 |
| 2006/0272668 | A1 | 12/2006 | Wyatt et al. | |
| 2006/0275072 | A1 | 12/2006 | Petit | |
| 2007/0272269 | A1 | 11/2007 | Wyatt et al. | |
| 2007/0289602 | A1 | 12/2007 | Simmons | |

OTHER PUBLICATIONS

Top Skin Care Products, Facial Skin Care, Skin Care Brush—Clarisonic, retrieved on Mar. 8, 2010 a6 <<http://www.clarisonic.com/us/>>, pp. 1-2.

Lancome Oscillation Powerfoundation, retrieved on Mar. 8, 2010, at <<http://www.lancome-usa.com/makeup/foundations/oscillation-powerfoundation.aspx>>, p. 1 of 1.

* cited by examiner

*Primary Examiner* — Laura C Guidotti
(74) *Attorney, Agent, or Firm* — Lee & Hayes, PLLC

(57) ABSTRACT

An applicator for applying a product includes a motor and a switch for automatically rotating and/or oscillating an applicator head. By virtue of having a motor with a throttling gear, the applicator is capable of rotating and/or oscillating at controlled frequencies during application of cosmetic, medicinal, or other products to a surface.

21 Claims, 8 Drawing Sheets

SECTION A-A

MOTORIZED ROTATING AND/OR OSCILLATING APPLICATOR

BACKGROUND

Devices exist for applying cosmetic or other products to surfaces. Such devices usually consist of a handle and an applicator head having a brush or sponge. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

Many cosmetic and personal care products are best applied in a rotational fashion, such as for example, buffing with foundation, blush, rouge, other loose powders, etc. Additionally, some product applications may benefit from oscillating the applicator head during application. For example, in the entertainment industry some makeup effects may require rotational and/or oscillation application.

Existing cosmetic and medicinal applicators and personal care implements have limited functionality, in that each applicator or implement is typically designed for manual rotation. Thus, consumers typically need to control the rotational frequency of the applicator with their own hands. Moreover, existing cosmetic and medicinal applicators and personal care implements are typically designed for manual oscillation as well. Thus, consumers who wish to rotate and/or oscillate their applicators are faced with the challenging, and often impossible task, of doing so manually. Accordingly, there remains a need in the art for improved applicators and implements.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This application describes applicators and implements comprising an applicator head, a motor, and a controller. The motor may be configured to rotate the applicator head at different rotational frequencies and/or oscillate the applicator head at different oscillational frequencies, such that a user may control the rotational and/or oscillational speed while buffing a surface with a product. By virtue of having a configurable controller for varying the rotational frequencies of the motor, such applicators and implements are controllable to apply various different cosmetic, medicinal, and/or personal care products in an automatically controlled rotational and/or oscillational manner.

Generally, an applicator according to this disclosure comprises an applicator head, an upper housing comprising a motor and a switch, and a lower housing removably coupled to the upper housing. In various embodiments, applicators may or may not include a controller, a throttling gear, and/or a rheostat for varying and/or controlling the rotational and/or oscillational frequency of the motor.

The switch for activating the motor may be coupled to the inside of the lower housing by a variety of attachment means, or it may protrude from the lower housing exposing a toggle actuator, pushbutton actuator, a touch sensitive actuator, combinations of any of the foregoing, or the like. The switch may also be configured to activate the motor by rotation of the lower housing, depression of the lower housing, touch sensitivity, combinations of any of the foregoing, or the like.

Illustrative Applicator with Rotating Brush

Figure 1:
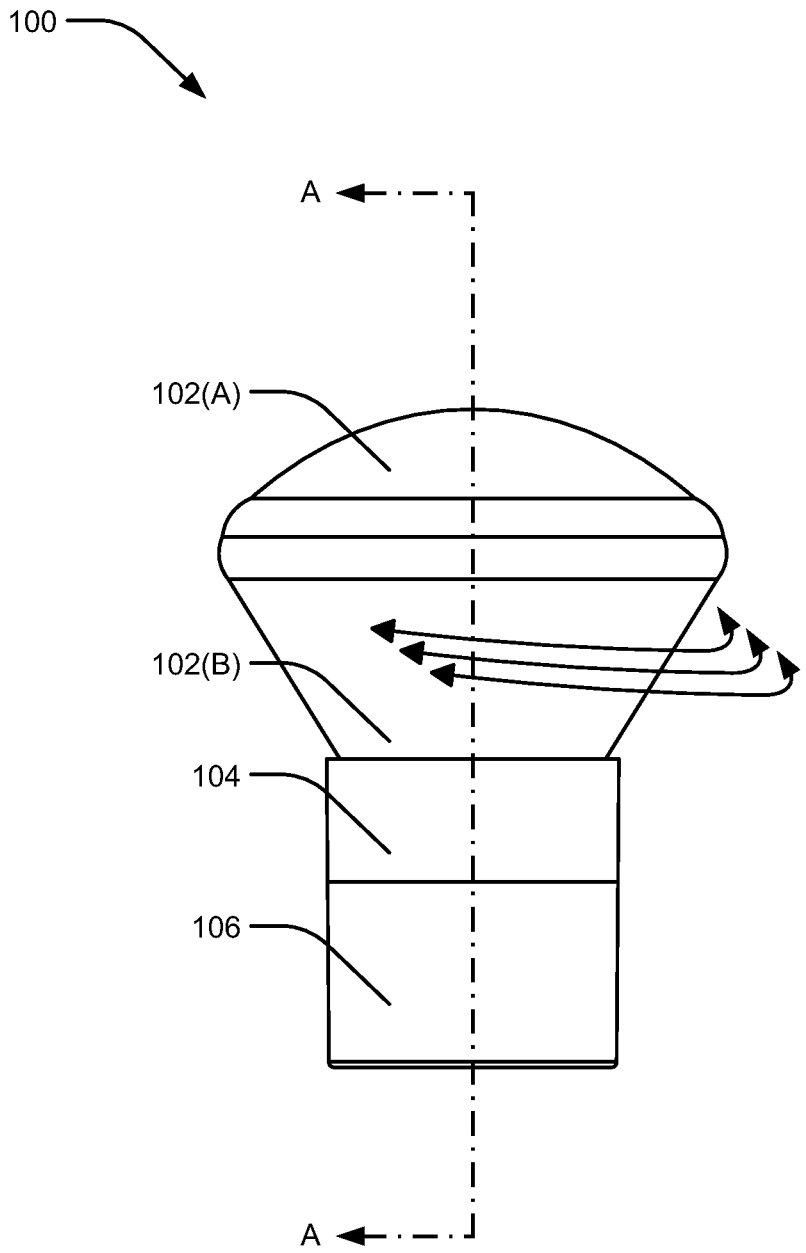
FIG. 1 depicts an illustrative applicator with a rotating and/or oscillating applicator head coupled to a handle.

FIG. 1 depicts an illustrative applicator 100 with a rotating and/or oscillating applicator head 102. The applicator head 102 is depicted as including an upper portion of the applicator head 102(A) and a lower portion of the applicator head 102(B); however, the applicator head 102 may be one solid sponge, brush, or other type of applicator head. The lines between the upper portion of the applicator head 102(A) and the lower portion of the applicator head 102(B) are intended to represent the curvature and/or two-dimensional perspective of at least one possible three-dimensional shape of one exemplary applicator head 102. However, applicator heads may take on any other desired shape.

The applicator 100 may include an upper housing 104 and a lower housing 106. By way of example only, the upper housing 104 and the lower housing 106 may be made of metal, e.g., aluminum, titanium, steel, nickel, tin, copper, brass, alloys thereof, etc., or plastics, ceramics, composites, or the like. Additionally, the applicator head 102 may be coupled to the upper housing 104, while the lower housing 106 may be removably coupled to the upper housing 104. This may allow for easy manual removal of the lower housing 106 from the upper housing 104.

When activated, the applicator head 102 may rotate at a controlled frequency either clockwise or counterclockwise. The applicator head 102 may also oscillate at a controlled frequency in either a clockwise or counterclockwise direction. Oscillation of the applicator head 102 may be accomplished by vibrating the applicator head 102 or by intermittently, and rapidly, changing the rotational direction, i.e., rapidly rocking the applicator head 102 back and forth. In one embodiment, when activated, the applicator head 102 may both rotate and oscillate at the same time at a controlled frequency in a clockwise, clockwise-like, counterclockwise, or counterclockwise-like direction. Additionally, in one implementation, a controller may be configured to control operation (rotation, oscillation, or both) based on a user's selection or method of actuation. The arrows of FIG. 1 are intended to represent the rotation and/or oscillation of the applicator head 102 relative to the upper and lower housings 104 and 106.

Figure 2:
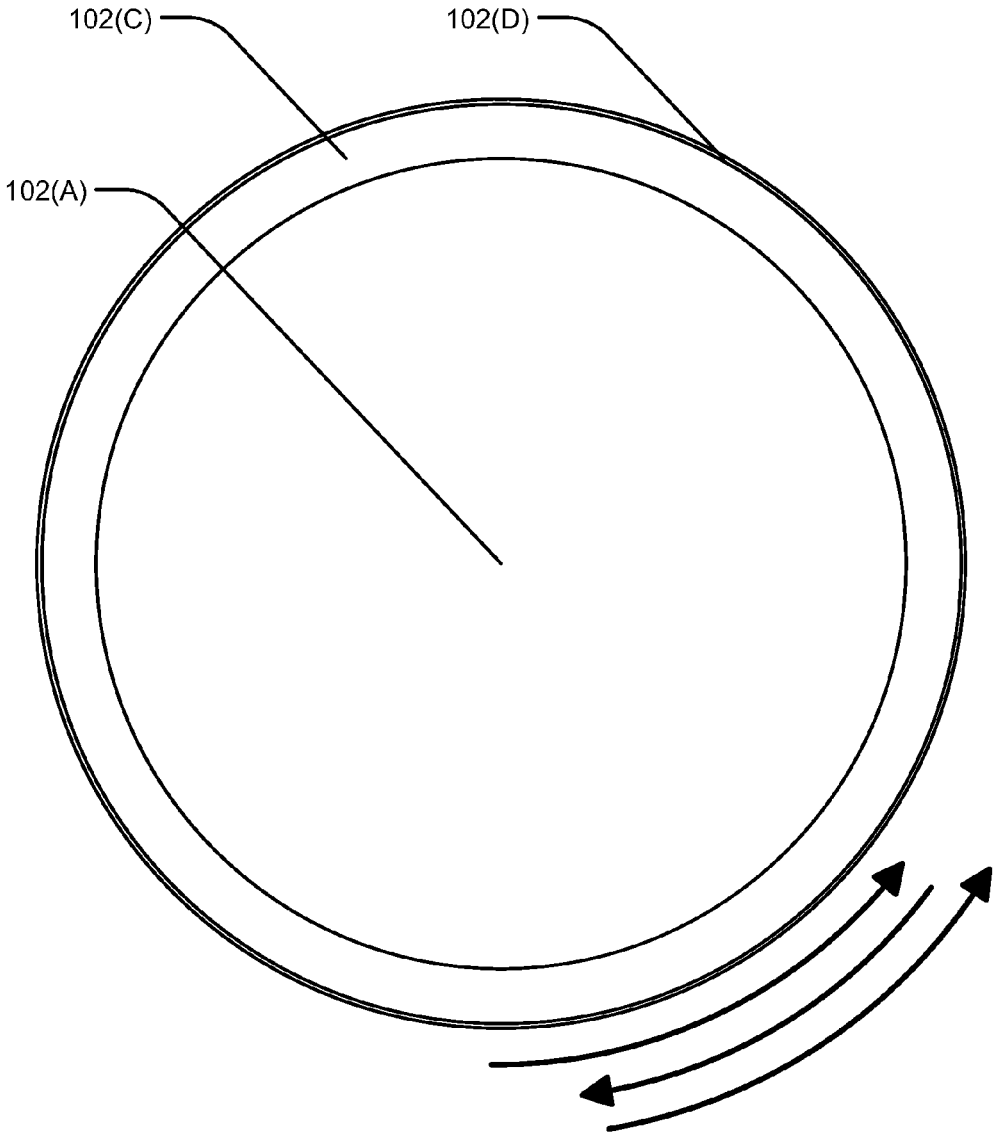
FIG. 2 is a top view of the head of the applicator of FIG. 1.

FIG. 2 is a top perspective view of the applicator head 102 of FIG. 1. In this view, applicator head 102 includes the upper portion of the applicator head 102(A), and two outer portions of the applicator head 102(C) and 102(D). As can be seen in FIG. 2, the diameter of the upper portion of the applicator head 102(A) may be less than both of the outer portions of the applicator head 102(C) and 102(D). Additionally, the diameter of the outer portion of the applicator head 102(C) may be less than that of the outer portion of the applicator head 102(D). By way of example only, the upper portion of the applicator head 102(A) may be taller in the center than at the edges, such that the applicator head 102 may be curved as seen in FIG. 1. However, applicator head 102 may be any shape or type suitable for applying a product to a surface. For example, the applicator head 102 may be the shape shown in FIGS. 1 and 2, or it may be cylindrical, spherical, or any other shape, and it may be a sponge applicator, a brush applicator, or other type of applicator as well.

As shown in FIG. 2, the arrows are intended to depict one example of rotational and/or oscillational motion by the applicator head 102. For example, the applicator head may rotate and/or oscillate in a clockwise and/or counterclockwise direction perpendicularly to a shaft longitudinally coupled to the bottom of the applicator head 102. By way of example only, the arrow closest to the applicator head 102 may indicate a counterclockwise rotation, the next closest arrow to the applicator head 102 may indicate a brief clockwise rotation, and the arrow farthest from the applicator head 102 may indicate an additional counterclockwise rotation. In this manner, the applicator head 102 may both rotate and oscillate at the same time by oscillating back and forth while rotating in one direction (counterclockwise in this example) more than the other. In another implementation, the applicator head 102 may only rotate in a clockwise or counterclockwise manner, or it may only oscillate.

Additionally, and by way of example only, in one implementation the rotation and/or oscillation may be achieved by oscillation of the applicator head as described above and simultaneous orbital rotation (not shown) of the applicator head 102.

Illustrative Applicator with Rotating Brush (Exploded)

Figure 3:
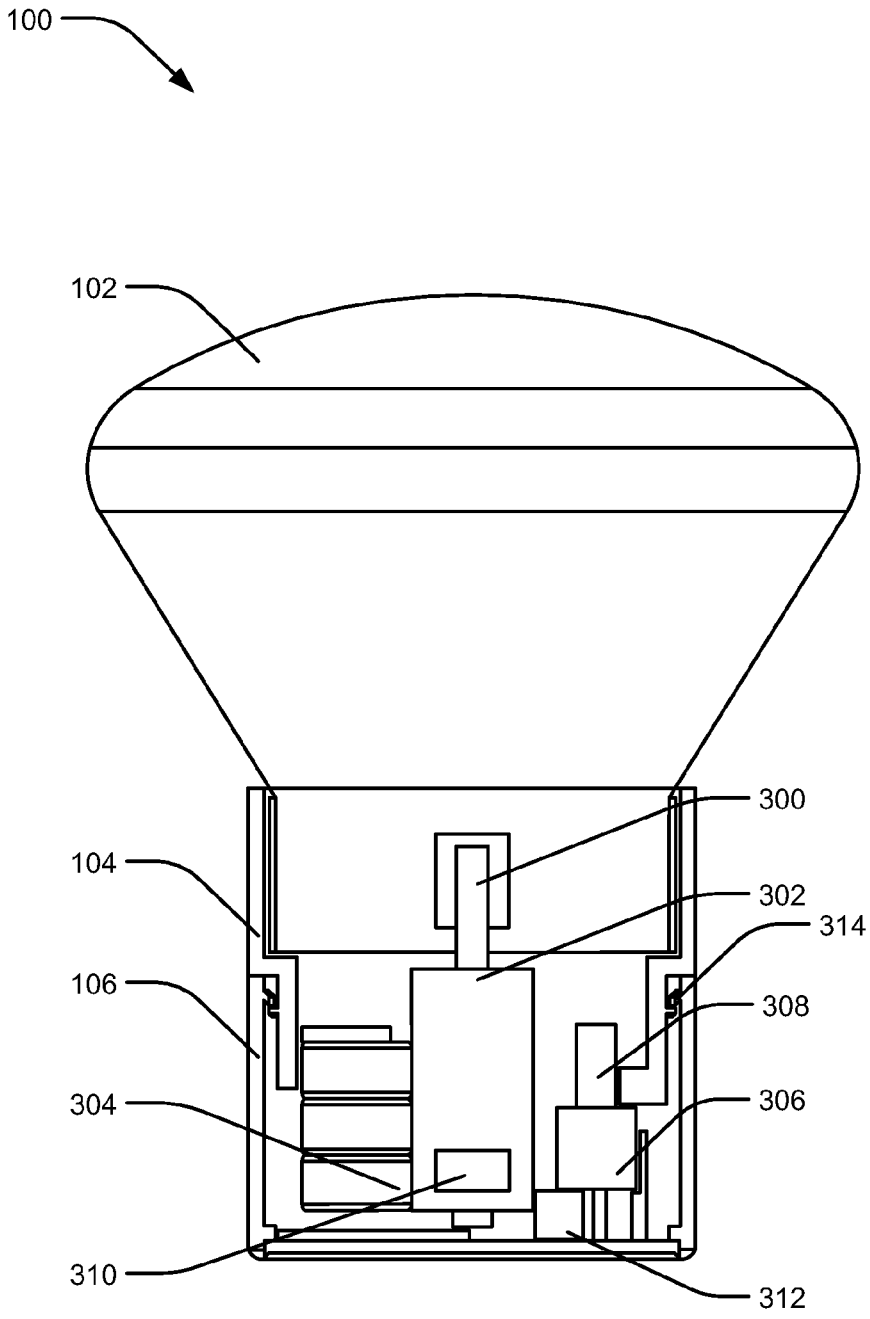
FIG. 3 is a cross-sectional view of the applicator shown in FIG. 1, taken along line A-A of FIG. 1.

FIG. 3 is a cross-sectional view of the applicator 100 shown in FIG. 1. As shown in FIG. 3, the applicator 100 includes an applicator head 102, an upper housing 104, and a lower housing 106. As noted above, regarding FIG. 1, the applicator head 102 may be coupled to the upper housing 104 and the lower housing 106 may be removably coupled to the upper housing 104. By way of example, however, the applicator head 102 may not be directly coupled to the upper housing 104. In this implementation, the applicator head 102 may be coupled to the upper housing 104 by being coupled to a motor shaft 300, which may be coupled to a motor 302, which in turn may be coupled to the upper housing 104. Thus, in other words, the applicator head 102 may be indirectly coupled to the upper housing 104 by way of the motor 302 and shaft 300.

As noted above, the motor 302 may be directly coupled to the upper housing 104 (not shown). However, in another implementation, the motor 302 may be indirectly coupled to the upper housing 104 by way of a battery reservoir 304 for housing a battery or batteries. That is, the battery reservoir 304 may be directly coupled to the upper housing 104 and directly coupled to the motor 302. In any event, the battery reservoir 304 may be electrically coupled to the motor 302 such that when the appropriate amount of battery power is supplied, electricity may be conveyed to the motor 302 to rotate the shaft 300.

As shown in FIG. 3, the applicator 100 may also include a switch housing 306 coupled to an actuator 308. The switch housing 306 may house a switch (not shown) for activating the motor 302 and may be coupled to the upper housing 104. The actuator 308 may be removably coupled to the lower housing 106 and may activate the switch within the switch housing 306, which in turn may activate the motor 302. Additionally, the switch housing 306 may be electrically coupled to the battery reservoir 304 and/or the motor 302. In one implementation, the battery reservoir 304 and the motor 302 may each be electrically coupled to only the switch housing 306. In this way, the switch housing 306 (when activated by the actuator 308) may control the flow of electricity from the battery (not shown) within the battery reservoir 304 to the motor 302.

Applicator 100 may also include a throttling gear 310 and/or a controller 312 configured to control the rotational and/or oscillational frequency of the motor 302. In one implementation, the throttling gear 310 may be configured to vary the rotational and/or oscillational frequencies of the motor 302 while the controller 312 may be configured to control the throttling gear. The throttling gear 310 and/or the controller 312 may be coupled to the motor 302 and/or the upper housing 104. In one implementation, the throttling gear 310 may only vary the rotational frequency of the motor 302. In another implementation, the throttling gear 310 may only vary the oscillational frequency of the motor 302. In yet another implementation, the throttling gear 310 may vary both the rotational and oscillational frequencies of the motor 302. The controller 312 may be configured to control the throttling gear and/or the motor directly. Additionally, a rheostat, a potentiometer, or other type of circuitry may be used to control the throttling gear and/or the motor.

Applicator 100 may also be configured to revolve the motor 302 around a longitudinal axis (not shown) of the upper housing 104 in such a way that the applicator head 102 may oscillate at a predetermined frequency via oscillation from the motor shaft 300 while the motor 302 rotates orbitally within the upper and lower housings 104 and 106. In one implementation, the motor 302 may be coupled to the upper housing 104 by disc and ring gears (not shown), thereby allowing the motor 302 to orbit in a small diameter relative to the diameter of the applicator 100 while still rotating the applicator head 102. The effect may resemble a planet spinning on its own axis as it rotates around the sun.

By way of example only, the lower housing 106 may act as a cover, to conceal and protect the contents coupled to the upper housing 104 and may be watertight, hermetically sealed, or the like. Additionally, by way of example only, the lower housing 106 may be removably coupled to the upper housing 104 by way of a snap retention mechanism 314. The snap retention mechanism 314 may include complementary parts configured to allow the lower housing 106 to be manually snapped-on and/or snapped-off of the upper housing 104. Additionally, other coupling mechanisms (e.g., press fit, magnetic, threaded connections, etc.) may be alternatively used as described in more detail below.

Figure 4:
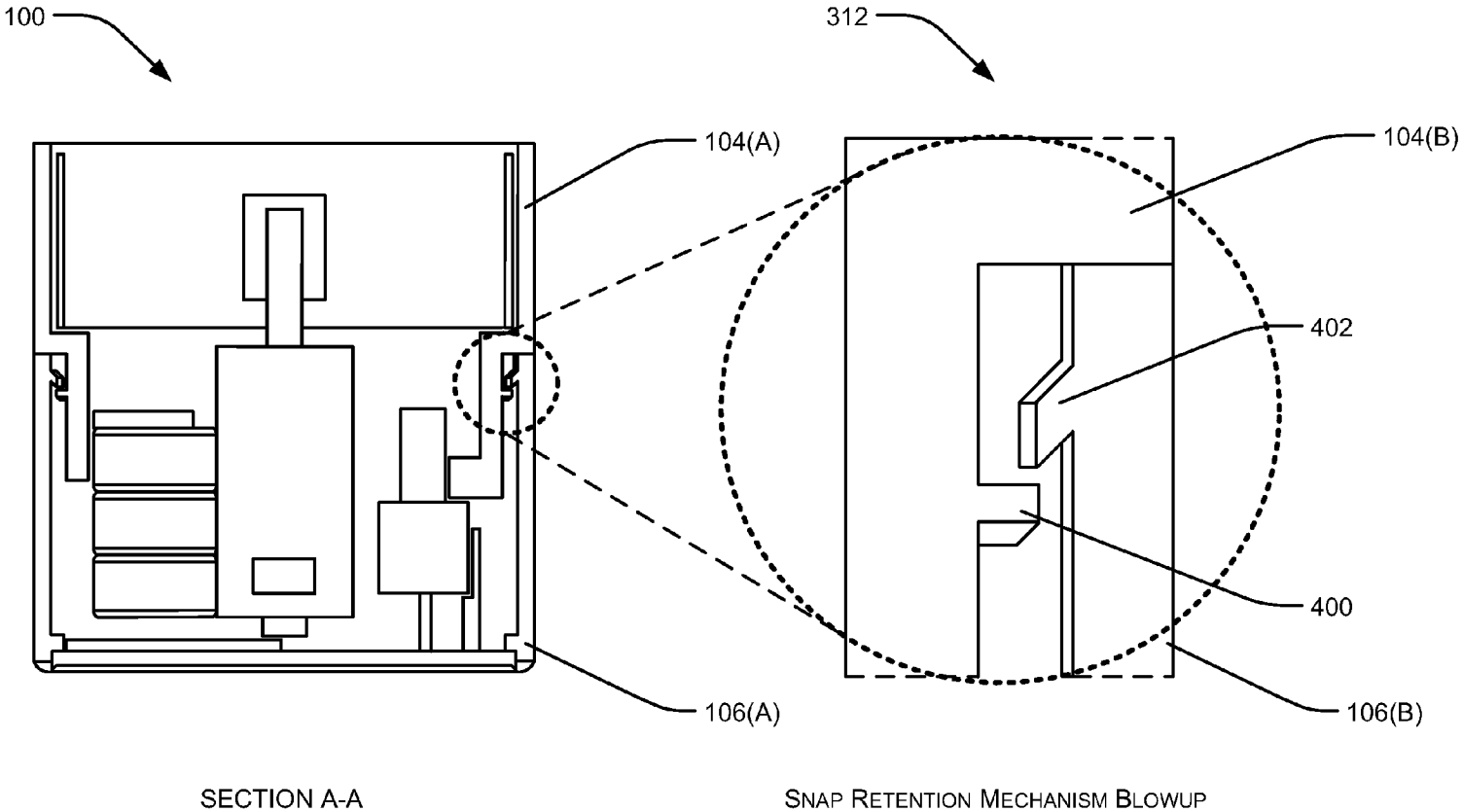
FIG. 4 is a blowup view of the snap retention mechanism seen in the applicator of FIG. 3.

FIG. 4 includes the cross-sectional view of the applicator 100 shown in FIG. 3 and a blowup view of the snap retention mechanism 312. For explanatory purposes, the upper housing 104 of the applicator 100 is labeled 104(A) and the upper housing 104 of the snap retention mechanism 312 is labeled 104(B) in FIG. 4. Similarly, the lower housing 106 of the applicator 100 is labeled 106(A) and the lower housing 106 of the snap retention mechanism 312 is labeled 106(B) in FIG. 4. Upper and lower housings 104(A) and 106(A) are shown on the cross-sectional view of the applicator 100, while upper and lower housings 104(B) and 106(B) are shown on the blowup view of the snap retention mechanism 312; however, they are intended to represent the same parts. As shown in FIG. 4, and by way of example only, the snap retention mechanism 312 may be configured with a protruding or recessed collar 400 coupled to (or disposed around) the circumference of the upper housing 104. Also, by way of example only, the snap retention mechanism 312 may be further configured with a complimentary member 402 coupled to (or disposed upon) the lower housing 106. The snap retention mechanism 312 may be configured such that when the lower housing 106 is manually pressed onto the upper housing 104 the upper and lower housings 104 and 106 snap-on to one another, thus removably coupling them together. In another implementation, the snap retention mechanism 312 may be configured to require a user to manually press-and-turn the upper and lower housings 104 and 106 together to effectuate the removable coupling.

Additionally, alone or in combination with the snap retention mechanism 312, a magnetic retention mechanism (not shown) may be used to removably couple (or aid in the removable coupling of) the upper and lower housings 104 and 106. In one embodiment, the magnetic retention mechanism (not shown) may comprise a magnetic ring (not shown) disposed around the circumference of the collar 400 to attract and retain a ferromagnetic member (also not shown) disposed in, on, or about the circumference of the lower housing 106.

As noted above, while the retention mechanism used to removably couple the upper and lower housings 104 and 106 is shown as a snap retention mechanism 312, other types of retention mechanisms could be used. For example, a magnetic retention mechanism like the one discussed above could be used. Additionally, other suitable types of retention mechanisms may include a push-and-twist lock such as a bayonet retention mechanism, an interference fit retention mechanism, a threaded rotational retention mechanism, or combinations of any of the foregoing, or the like. Moreover, any shape or type of applicator head 102 may be used as well. For example, any type of applicator head may be used, such as but not limited to, a sponge applicator head (as shown), a brush applicator head, a foam applicator head, a dovetail sponge applicator head, or any other type of medicinal or cosmetic applicator head.

Illustrative Applicator with Rotating Brush (Activation)

Figure 5:
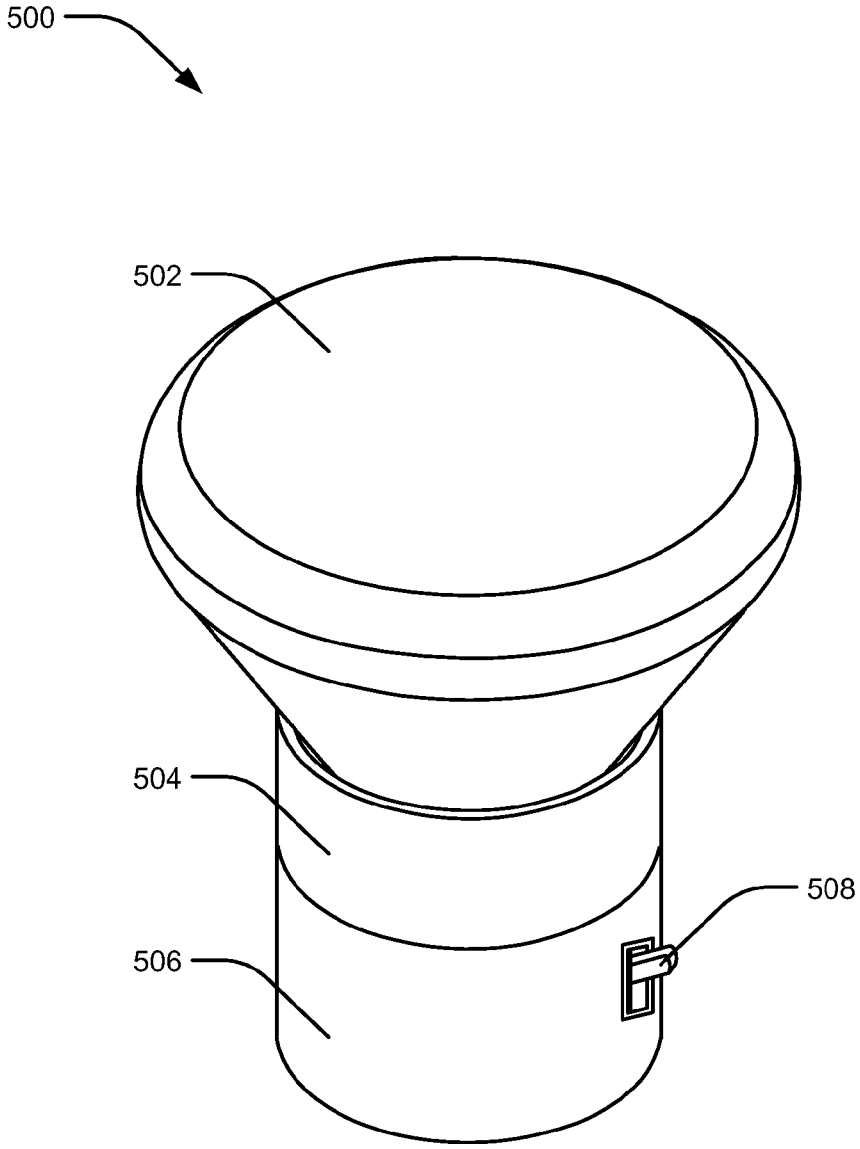
FIG. 5 depicts an illustrative applicator with a rotating and/or oscillating applicator head coupled to a handle configured with a toggle switch.
Figure 6:
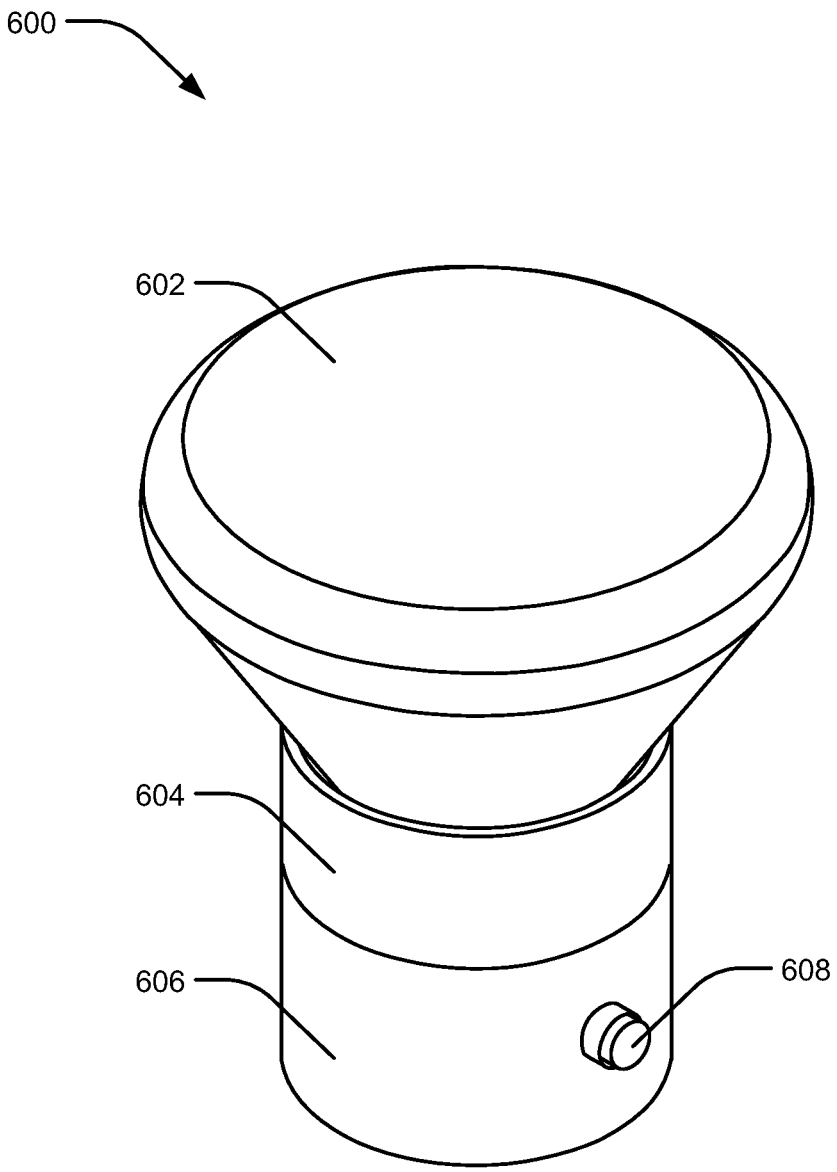
FIG. 6 depicts an illustrative applicator with a rotating and/or oscillating applicator head coupled to a handle configured with a pushbutton switch.
Figure 7:
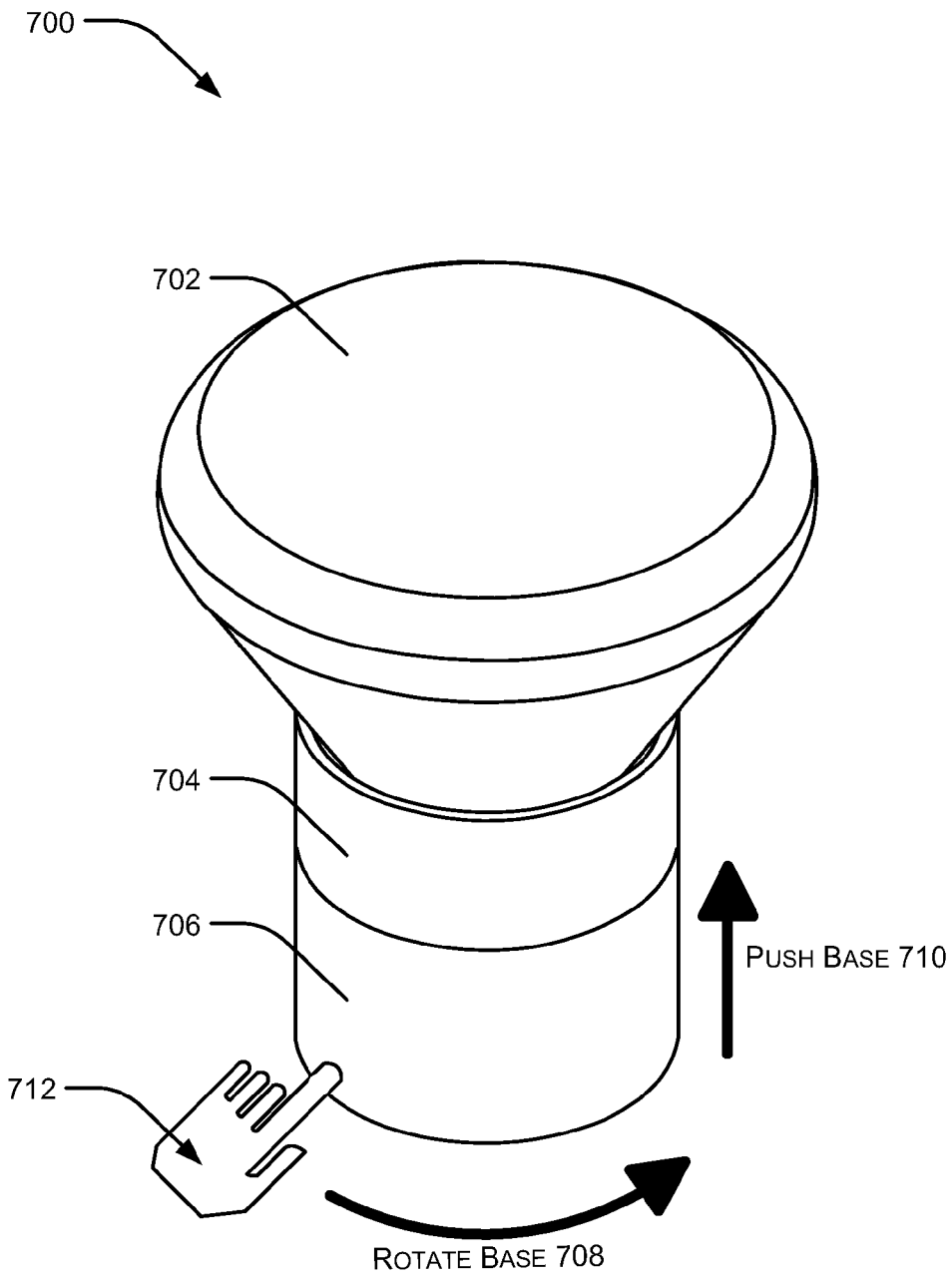
FIG. 7 depicts an illustrative applicator with a rotating and/or oscillating applicator head coupled to a handle configured with a rotating base switch, a push-base switch, and/or a touch switch.

FIGS. 5-7 depict illustrative applicators 500, 600, and 700 with rotating applicator heads detailing several different methods of activating the motor 302 shown in FIG. 3 (not shown here). Each of applicators 500, 600, and 700 may be configured similar to applicator 100. That is, each of applicators 500, 600, and 700 may include a motor 302, a shaft 300, a throttling gear 310, upper and lower housings 104 and 106, and a battery reservoir 304. Additionally, they may each include an applicator head 102, a retention mechanism such as the snap retention mechanism 312 of FIG. 3, a switch housing 306, and an actuator 308 as well. However, the actual configuration of the switch housing 306 and the actuator 308 may be different depending on the type of motor activation mechanism. Additionally, any configuration of the above listed parts may be used including configurations with more or less parts than listed above.

FIG. 5 depicts an illustrative applicator 500 with a rotating and/or oscillating applicator head 502. The applicator head 502 may be internally coupled to a motor and/or shaft (not shown) which may be coupled to the upper housing 504. Similar to the applicator 100 of FIGS. 1-4, applicator 500 may have a lower housing 506 removably coupled to an upper housing 504. As shown in FIG. 5, and by way of example only, a toggle switch 508 may be coupled to the lower housing 506. In other implementations, however, the toggle switch 508 may be coupled to the upper housing 504, or it may be coupled to the lower housing 506 but may be located on the bottom instead of the side.

The toggle switch 508 may be configured such that power is supplied to the internal motor (not shown here) to rotate and/or oscillate the applicator head 502 when the toggle switch 508 is placed in an "up" position (as shown). Alternatively, the toggle switch 508 may be configured to provide power to the motor when placed in a "down" position. In yet another implementation, the throttling gear (also not shown here) may be configured to vary the rotational and/or oscillational frequency of the applicator head 502 based on the distance of the toggle switch 508 from the "down," or "off," position. That is, and by way of example only, the toggle switch 508 may be configured to supply no power to the motor when in the "down," or "off," position, full power to the motor when in the "up" position (that is, maximum rotational and/or oscillational frequency), and varying rotational and/or oscillational frequencies when in between the "down" and "up" positions (that is, the frequency may gradually increase as the switch is gradually moved from the "off" to the "on" position).

FIG. 6 depicts an illustrative applicator 600 with a rotating and/or oscillating applicator head 602. Similar to applicator 500 of FIG. 5, the applicator head 602 may be internally coupled to a motor and a shaft (not shown here) which may be coupled to the upper housing 604. Additionally, applicator 600 may have a lower housing 606 removably coupled to the upper housing 604. As shown in FIG. 6, and by way of example only, a pushbutton switch 608 may be coupled to the lower housing 606. In other implementations, however, the pushbutton switch 608 may be coupled to the upper housing 604 or coupled to the lower housing 606 but located on the bottom rather than on the side.

The pushbutton switch 608 may be configured such that power is supplied to the internal motor to rotate and/or oscillate the applicator head 602 when the pushbutton switch 608 is depressed an odd number of times. Additionally, the pushbutton switch may be configured to provide power to the motor when depressed an even number of times. Alternatively, the pushbutton switch 608 may be configured opposite to that described above, such that an even number of depressions provides power and an odd number of depressions eliminates power. In yet another implementation, the pushbutton switch 608 may be configured to have an "in" position and an "out" position. In this implementation, the "in" and "out" positions may be configured to either provide full power or no power to the internal motor to rotate and/or oscillate the applicator head 602. As discussed above regarding the applicator 500 of FIG. 5, the throttling gear (not shown here) may be configured to provide varying rotational and/or oscillation frequencies based on how far "in" and/or "out" the pushbutton switch 608 is depressed.

In yet another implementation, the pushbutton switch 608 may be configured to effectuate a step function by providing increasing amounts of power to the motor as the number of depressions of the pushbutton switch increases, up until a threshold number of depressions is reached, at which point, power to the motor will be eliminated. In this way, the rotational and/or oscillational frequency may be controlled by a number of depressions of the pushbutton switch 608. By way of example only, the pushbutton switch 608 may be configured to increase power to the motor (and thus, rotational frequency of the applicator head) for each successive depression of the pushbutton switch 608 followed by turning the motor "off" at the third depression of the pushbutton switch 608. In other implementations, however, there could be more or less levels of power. In these alternative configurations, power may be eliminated to the motor at more or less than the third depression of the pushbutton switch 608.

FIG. 7 depicts the illustrative applicator 700 with a rotating and/or oscillating applicator head 702. Similar to applicators 500 and 600 of FIGS. 5 and 6, the applicator head 702 may be internally coupled to a motor and a shaft (not shown here) which may be coupled to the upper housing 704. Additionally, the applicator 700 may have a lower housing 706 removably coupled to the upper housing 704. As shown in FIG. 7, and by way of example only, motor activation may be effectuated by at least a rotating base switch 708 (i.e., by rotating the lower housing 706), a push-base switch 710 (i.e., by pushing the lower housing 706 toward the upper housing 704), or a touch switch 712 using touch sensitivity (i.e., by touching the base, upper housing 704, collar, or other surface of the applicator).

In one implementation, as shown in FIG. 7 and mentioned above, motor activation may be effectuated by rotating the base 708. In this implementation, the lower housing 706 may have a standard position for which the internal switch (not shown) is configured to prevent the supply of power to the motor (also not shown). In order to activate the motor, the lower housing 706 may be turned a predetermined direction and/or a predetermined distance relative to the upper housing 704. By way of example only, if the applicator 700 is off (and thus, the lower housing 706 is in the "off" position) the motor may be activated by rotating the lower housing 706 90° in a clockwise direction relative to the upper housing 704. Additionally, the throttling gear (also not show) may be configured to vary the rotational and/or oscillational frequency of the applicator head 702 based on the rotational distance that the lower housing 706 is turned from the standard, or "off," position. That is, and by way of example only, the internal switch (not shown) may be configured to supply no power to the motor when in the lower housing 706 is in the standard, or "off," position, full power to the motor when in the 90° position discussed above (that is, maximum rotational and/or oscillational frequency), and varying rotational and/or oscillational frequencies when in between the standard and 90° positions (that is, the frequency may gradually increase as the lower housing 706 is gradually moved from the standard to the 90° position). Additionally, any variations of rotational degree and/or direction of the lower housing 706 to activate and/or control the rotational and/or oscillational frequency of the applicator head 702 may be used.

In another embodiment, also shown in FIG. 7 and mentioned above, motor activation may be effectuated by pushing the base 710. In this implementation, the lower housing 706 may be configured to act much like the pushbutton switch 608 of FIG. 6. By way of example only, pushing the base 710 may provide all, or additional, functionalities and manners of operation described above with reference to the pushbutton switch 608 of FIG. 6. For example, pushing the base 710 may activate and/or deactivate the motor (not shown) to rotate and/or oscillate the applicator head 702. Additionally, varying rotational and/or oscillational frequencies may be attained based on varying degrees of depression of the base 710 and/or a varying number of depressions of the base 710.

In yet another embodiment, also shown in FIG. 7 and mentioned above, motor activation may be effectuated by touching the base 712. In this implementation, the lower housing 706 may be configured with a touch sensitive switch (not shown) for activating the motor (also not shown). By way of example only, this may be implemented by way of electromagnetic induction, any type of capacitance touch switch, any type of resistance touch switch, combinations of any of the foregoing, or the like. In one implementation of touching the base 712, a capacitance touch switch may be coupled to the upper and/or lower housings 704 and/or 706 such that when a user touches either or both of the upper and/or lower housings 704 and/or 706, power is supplied to the motor to rotate and/or oscillate the applicator head 702. In this way, touching the base 712 may import all, or additional, functionalities and manners of operation described above with reference to the pushbutton switch 608 of FIG. 6 and/or pushing the base 710 of FIG. 7. By way of example only, a user may first turn on the applicator 700 by touching the upper and/or lower housings 704 and/or 706 and then may turn off the applicator 700 by again touching the upper and/or lower housings 704 and/or 706. Additionally, as described above, varying rotational and/or oscillational frequencies may be attained based on varying amounts of surface area touched, varying number of housings touched, or varying amounts of time for which the touching of the base 712 transpires.

In another implementation of touching the base 712, a resistance touch switch (not shown) may be coupled to the upper and/or lower housings 704 and/or 706 such that when a user touches either or both of the upper and/or lower housings 704 and/or 706, power is supplied to the motor to rotate and/or oscillate the applicator head 702. In this implementation, a user may need to hold onto the applicator 700, thus touching the upper and/or lower housings 704 and/or 706 in at least two different positions, in order for power to be supplied to the motor. In other words, constant connection between fingers and resistance touch switch sensors may be required in order to maintain power to the motor and, thus, maintain rotation and/or oscillation of the applicator head 702. Additionally, pressure sensors (not shown) may be employed to vary the rotational and/or oscillational frequencies of the applicator head 702 based on an amount of pressure supplied by a user while touching the base 712.

In yet another implementation, operation of the applicator 700 may be effectuated and controlled by any combination of the above mentioned actions. By way of example, and not limitation, one combination may include activation of the motor by touching the base 712. Once activated, pushing the base 710 may effectuate a rotational and/or oscillational direction change, while rotating the base 708 may control variations in rotational and/or oscillational frequency. Additionally, any other combinations of actions may be utilized to effectuate any combination of applicator 700 functions.

Figure 8:
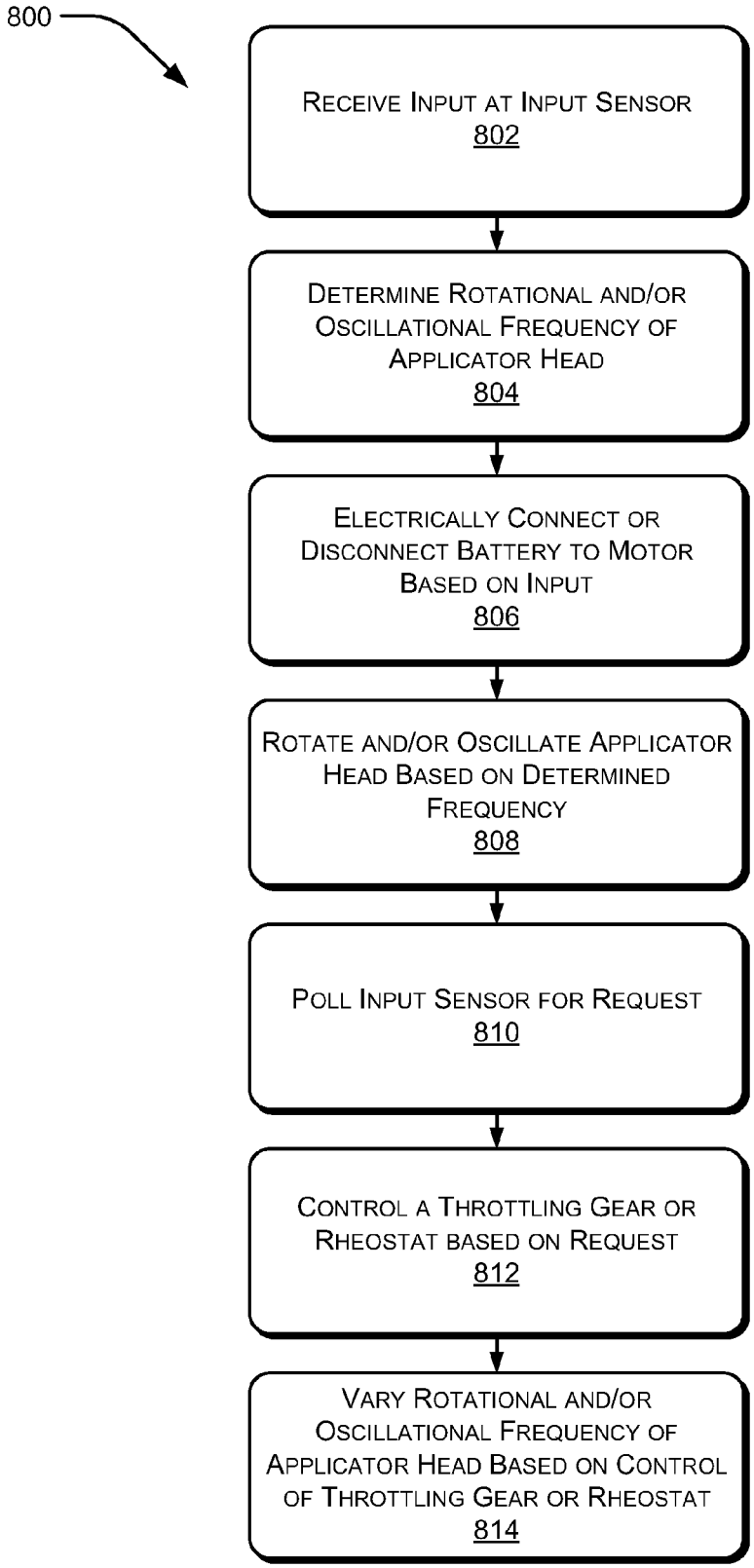
FIG. 8 is a flowchart illustrating details of a method for implementing a motorized rotating and/or oscillating applicator.

FIG. 8 is a flow diagram of one illustrative method 800 for implementing a motorized rotating and/or oscillating applicator. In this particular implementation, the method 800 may begin at block 802 where the method 800 may receive an input at an input sensor from a user. As described above in reference to FIGS. 5-7, many variations exist as potential methods of input and input sensors. At block 804, the method 800 may determine a rotational and/or oscillational frequency for an applicator head. Based on the input, the method 800 may then electrically connect or disconnect a battery to the applicator's motor at block 806. At block 808, the method 800 may rotate and/or oscillate the applicator head based on the determined frequency from block 804. While the motor is activated, the method 800 may continuously poll the input sensor at block 810. The input sensor may set a flag or communicate in some other way to the controller that, or if, a user requests to change the rotational and/or oscillational frequency of the motor. Based on such a request, the method 800 may control a throttling gear, rheostat, potentiometer, or other type of control circuitry at block 812 and then may terminate at block 814 by varying the rotational and/or oscillational frequency of the applicator head based on the controlled element. Alternatively, the method 800 may terminate by changing the rotational and/or oscillation frequency to zero (not shown) or by electrically disconnecting the battery to the motor (also not shown), thus turning the applicator "off".

Illustrative methods and devices for a motorized rotating and/or oscillating applicator are described above. Some or all of these devices and methods may, but need not, be implemented at least partially by an applicator such as that shown in FIGS. 1-7. It should be understood, however, that certain acts in the methods need not be performed in the order described, may be rearranged, modified, and/or may be omitted entirely, depending on the circumstances.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

What is claimed is:

1. An applicator comprising:
an upper housing;
a rotating and/or oscillating applicator head;
a motor coupled to the upper housing, the motor having a shaft defining a longitudinal axis, the shaft coupled to the applicator head;
a controller configured to oscillate the applicator head by oscillating the shaft while rotating the applicator head by rotating the shaft;
a switch electrically coupled to the motor comprising a switch housing and an actuator, the switch housing coupled to the upper housing; and
a lower housing removably coupled to and adjacent to the upper housing.

2. The applicator of claim 1, the actuator being internally coupled to the lower housing for activating the motor when the lower housing is rotated relative to the upper housing.

3. The applicator of claim 2, the controller further configured to provide power to the motor when the lower housing is rotated a first direction relative to the upper housing and/or remove power from the motor when the lower housing is rotated a second direction relative to the upper housing, the first direction being opposite to the second direction.

4. The applicator of claim 3, further comprising a throttling gear or a rheostat connectively coupled to the upper housing and the motor, the throttling gear or the rheostat being configured to vary a rotational frequency of the motor based on a turning angle of the lower housing relative to the upper housing.

5. The applicator of claim 4, the controller or the rheostat further configured to control the throttling gear to increase the rotational frequency of the motor as the turning angle of the lower housing increases relative to the upper housing.

6. The applicator of claim 2, the actuator further configured to activate the motor when the lower housing is depressed into the upper housing.

7. The applicator of claim 6, the controller further configured to provide power to the motor when the lower housing is depressed into the upper housing while the motor is off and/or remove power from the motor when the lower housing is depressed into the upper housing while the motor is on.

8. The applicator of claim 1, the actuator comprising a toggle exposed to a user.

9. The applicator of claim 1, the actuator comprising a pushbutton exposed to a user.

10. The applicator of claim 1, the lower housing comprising a snap retention mechanism for snapping-on and/or snapping-off of the upper housing.

11. The applicator of claim 1, further comprising a battery reservoir within the upper housing, the battery reservoir electrically coupled to the motor and/or the switch.

12. The applicator of claim 1, the applicator head comprising an applicator brush or a sponge applicator.

13. An applicator device for applying a product to a surface, the applicator device comprising:
an upper housing;
an applicator head;
a battery powered motor for rotating the applicator head, the motor coupled to the upper housing and having a shaft defining a longitudinal axis, the shaft being coupled to the applicator head;
a controller configured to oscillate the applicator head by oscillating the shaft while rotating the applicator head by rotating the shaft;
a lower housing removably coupled to the upper housing by a snap retention mechanism;
a switch electrically coupled to the motor comprising a switch housing and an actuator, the switch housing being coupled to the upper housing and the actuator being coupled to the lower housing; and
a throttling gear connectively coupled to the upper housing and the motor, the throttling gear configured to control a rotational frequency of the motor, the motor configured to rotate and/or oscillate the applicator head by rotating and/or oscillating the shaft.

14. The applicator device of claim 13, the applicator head comprising an applicator brush or a sponge applicator.

15. The applicator device of claim 13, wherein the controller is configured to activate the motor when the lower housing is rotated relative to the upper housing.

16. The applicator device of claim 13, the snap retention mechanism comprising a collar disposed in the upper housing and a complimentary member disposed in, on, or about the lower housing.

17. An applicator comprising:
an upper housing;
a rotating and/or oscillating applicator head;
a motor coupled to the upper housing, the motor having a shaft defining a longitudinal axis, the shaft coupled to the applicator head;
a controller configured to oscillate the applicator head by oscillating the shaft while rotating the applicator head by rotating the shaft;
a switch electrically coupled to the motor comprising a switch housing and an actuator, the switch housing coupled to the upper housing; and
a lower housing removably coupled to the upper housing;
the actuator being internally coupled to the lower housing such that rotating the lower housing relative to the upper housing activates the motor.

18. The applicator of claim 17, wherein the controller is further configured to provide power to the motor when the lower housing is rotated a first direction relative to the upper housing and/or remove power from the motor when the lower housing is rotated a second direction relative to the upper housing, the first direction being opposite the second direction.

19. The applicator of claim 17, further comprising a throttling gear or a rheostat connectively coupled to the upper housing and the motor, the throttling gear or the rheostat being configured to vary a rotational frequency of the motor based on a turning angle of the lower housing relative to the upper housing.

20. The applicator of claim 19, wherein the controller or the rheostat is configured to control the throttling gear to increase the rotational frequency of the motor as the turning angle of the lower housing increases relative to the upper housing.

21. The applicator of claim 17, further comprising a battery reservoir within the upper housing, the battery reservoir being electrically coupled to the motor and/or switch.

* * * * *